US008831175B2

(12) United States Patent
Silver et al.

(10) Patent No.: US 8,831,175 B2
(45) Date of Patent: Sep. 9, 2014

(54) HYBRID X-RAY OPTIC APPARATUS AND METHODS

(76) Inventors: Eric H. Silver, Needham, MA (US); Gerald Austin, Reading, MA (US); David Caldwell, Norwell, MA (US); Ting Lin, Lexington, MA (US)

( * ) Notice: Subject to any disclaimer, the term of this patent is extended or adjusted under 35 U.S.C. 154(b) by 0 days.

(21) Appl. No.: 13/698,786

(22) PCT Filed: May 19, 2011

(86) PCT No.: PCT/US2011/037221

§ 371 (c)(1), (2), (4) Date: Apr. 3, 2013

(87) PCT Pub. No.: WO2011/146758

PCT Pub. Date: Nov. 24, 2011

(65) Prior Publication Data

US 2013/0188778 A1 Jul. 25, 2013

Related U.S. Application Data

(60) Provisional application No. 61/346,303, filed on May 19, 2010.

(51) Int. Cl.
*G21K 1/00* (2006.01)
*G21K 1/06* (2006.01)

(52) U.S. Cl.
CPC ..... *G21K 1/00* (2013.01); *G21K 2201/067* (2013.01); *G21K 1/067* (2013.01)
USPC ..... 378/84; 378/149

(58) Field of Classification Search
CPC ..... G21K 1/02; G21K 1/025; G21K 1/06; G21K 1/062; G21K 1/067; G21K 5/04; G21K 7/00; G21K 2201/06; G21K 2201/061; G21K 2201/064; G21K 2201/067; G21K 2207/00
USPC ..... 378/84, 85, 43, 145, 147, 149, 204, 378/210; 359/355, 359
See application file for complete search history.

(56) References Cited

U.S. PATENT DOCUMENTS 5,497,008 A * 3/1996 Kumakhov ..... 250/505.1
5,812,631 A * 9/1998 Yan et al. ..... 378/85

(Continued)

FOREIGN PATENT DOCUMENTS

JP 2003-528333 A 9/2003
JP 2003-288853 A 10/2003

OTHER PUBLICATIONS

International Search Report & Written Opinion from corresponding International application No. PCT/US2011/037221 mailed Jan. 13, 2012.

*Primary Examiner* — Thomas R Artman
(74) *Attorney, Agent, or Firm* — Wolf, Greenfield & Sacks, P.C.

(57) ABSTRACT

According to some aspects, a hybrid optic is provided. The hybrid optic comprises a capillary optic for receiving x-rays from an x-ray source at an entrance portion of the capillary optic and for providing x-rays at an exit portion of the capillary optic, and a grazing incidence multi-shell optic (GIMSO) coupled, at an entrance portion of the GIMSO, to the exit portion of the capillary optic to receive x-rays emerging from the exit portion of the capillary optic, the GIMSO including an exit portion for providing x-rays.

20 Claims, 13 Drawing Sheets

(56) References Cited

U.S. PATENT DOCUMENTS

| | | | | |
|---|---|---|---|---|
| 5,926,522 | A * | 7/1999 | McCarthy et al. | 378/84 |
| 6,094,471 | A * | 7/2000 | Silver et al. | 378/84 |
| 6,108,397 | A * | 8/2000 | Cash, Jr. | 378/34 |
| 6,278,764 | B1 * | 8/2001 | Barbee et al. | 378/84 |
| 6,594,337 | B1 * | 7/2003 | Silver et al. | 378/85 |
| 6,624,431 | B1 * | 9/2003 | Foster et al. | 250/505.1 |
| 6,993,115 | B2 | 1/2006 | McGuire et al. | |
| 7,106,826 | B2 * | 9/2006 | Poteet et al. | 378/45 |
| 7,406,151 | B1 * | 7/2008 | Yun et al. | 378/43 |
| 8,357,894 | B2 * | 1/2013 | Toth et al. | 250/306 |
| 2002/0021782 | A1 * | 2/2002 | McDonald | 378/84 |
| 2004/0089818 | A1 * | 5/2004 | Bowen et al. | 250/492.2 |
| 2004/0251419 | A1 * | 12/2004 | Nelson et al. | 250/370.09 |
| 2006/0098781 | A1 | 5/2006 | Bloom et al. | |
| 2013/0188778 | A1 * | 7/2013 | Silver et al. | 378/145 |

* cited by examiner

HYBRID X-RAY OPTIC APPARATUS AND METHODS

RELATED APPLICATION

This application claims priority under 35 U.S.C. §119(e) to Provisional Application No. 61/346,303, entitled "Wide Angle, High Throughput, Long Focal Length, X-ray Optic," filed May 19, 2010, which is herein incorporated by reference in its entirety.

BACKGROUND

Many broadband focusing x-ray optics take advantage of total reflection at glancing angles of incidence. Total reflection occurs when the angle of incidence at the entrance or opening of the x-ray optic is less than a critical angle that depends upon the properties of the reflecting material and the x-ray energy. This angle is referred to herein as the opening or acceptance angle. This category of x-ray optic is referred to herein as a grazing incidence multi-shell optic (GIMSO).

Many GIMSO designs have used metal, glass or plastic substrates with coatings of nickel, gold or iridium at glancing angles ranging from 10 to 150 arc minutes. Double-reflection geometries of the Wolter-I or Kirkpatrick-Baez types have been developed to focus a parallel beam of x-rays. The Wolter-I configuration typically consists of confocal paraboloid-hyperboloid shells and has been used most often for x-ray telescopes designed for high angular resolution. This optic is relatively axially compact, has a moderate field of view and, in some cases, a large number of surfaces can be nested to fill a substantial fraction of the available entrance aperture. An approximation to the Wolter-I design replaces the precisely figured optics with simple cones. Telescopes based upon this approximation have been developed for various astrophysical payloads. The Kirkpatrick-Baez geometry uses two parabolic surfaces for parallel-to-point focusing, and it has been adapted to point-to-point geometries for x-ray microscopes.

Another GIMSO design includes a surface shaped into a cylindrical spiral for single reflection, point-to-point focusing. The spiral surface may be a ribbon of smooth plastic coated with any one or combination of metals such as nickel, gold or iridium, or other suitable materials (e.g., high Z materials), and may be coated with multiple layers of such materials. Instead of a spiral, such a GIMSO may be formed from concentric cylinders of the same material. Other configurations of metal coated plastic may be used as well to guide, focus and/or concentrate x-rays.

Another category of optics for focusing x-rays are capillary optics typically formed from bundles of capillary tubes. In such capillary bundles, the x-rays undergo numerous reflections as they travel through the glass channels. The individual capillaries typically have lower efficiency than the GIMSO type optics discussed above and typically have significantly shorter focal lengths. However, the extremely large number of capillaries per solid angle of collection makes the ultimate throughput of the capillary system relatively high, and may have relatively large opening or acceptance angles as compared to GIMSO type optics. While to capillary optics are typically formed from glass tubes, capillary optics may be formed from any type of suitable material, and the term capillary optic refers herein to any optic formed from a collection of capillary tubes of any suitable material. Typically, capillary optics guide x-rays using multiple reflections (e.g., 5, 10 or even hundreds or more reflections).

SUMMARY

Some embodiments include a hybrid optic comprising a capillary optic for receiving x-rays from an x-ray source at an entrance portion of the capillary optic and for providing x-rays at an exit portion of the capillary optic, and a grazing incidence multi-shell optic (GIMSO) coupled, at an entrance portion of the GIMSO, to the exit portion of the capillary optic to receive x-rays emerging from the exit portion of the capillary optic. The GIMSO includes an exit portion for providing x-rays.

Some embodiments include an apparatus comprising an electron source capable of generating electrons to irradiate at least one sample to produce x-rays, a capillary optic for receiving x-rays emitted from the at least one sample in response to being irradiated at an entrance portion of the capillary optic and for providing x-rays at an exit portion of the capillary optic, a grazing incidence multi-shell optic (GIMSO) coupled, at an entrance portion of the GIMSO, to the exit portion of the capillary optic to receive x-rays emerging from the exit portion of the capillary optic, the GIMSO including an exit portion for providing x-rays, and at least one detector arranged to receive x-rays provided from the exit portion of the GIMSO.

Some embodiments include configurations combining one or more of the following: (1) a capillary optic configured to receive substantially diverging x-rays at the entrance portion and to provide substantially diverging x-rays at the exit portion of the capillary optic; (2) a GIMSO configured to receive the substantially diverging x-rays from the exit portion of the capillary optic and to provide substantially converging x-rays at the exit portion of the GIMSO; (3) a capillary optic configured to receive substantially diverging x-rays at the entrance portion and to provide substantially parallel x-rays at the exit portion of the capillary optic; and/or (4) a GIMSO configured to receive the substantially parallel x-rays from the exit portion of the capillary optic and to provide substantially converging x-rays at the exit portion of the GIMSO.

Some embodiments include a hybrid optic wherein a GIMSO is a single reflection optic or a double reflection optic. Some embodiments include a hybrid optic wherein the GIMSO includes one or more of the following: (1) a cylindrical spiral geometry; (2) a conical spiral geometry; (3) a nested cylinder geometry; and/or (4) a first surface positioned to reflect x-rays provided by the capillary optic and a second surface to reflect x-rays reflected from the first parabolic surface, wherein the first surface is a parabolic surface or a flat surface approximation and the second surface is a parabolic surface (or flat surface approximation), or a hyperbolic surface (or a conical surface approximation).

DETAILED DESCRIPTION

Scanning electron microscopes (SEMS) are widely used for materials and biomedical analysis. When targets are bombarded with electrons, x-rays are generated as a side effect. The x-ray spectrum provides information about elements contained in the target so that x-rays are often detected for analytical purposes. A detector such as a lithium-drifted silicon or germanium detector may be positioned very close to the target in a scanning electron microscope. Such detectors may be mounted on the end of a cold finger cooled by thermal conduction by means of a quantity of liquid nitrogen which boils at 77 Kelvin. Higher spectral resolution can be achieved utilizing detectors such as microcalorimeters cooled to approximately 0.06 Kelvin.

In the latter context, it may be desirable to locate the detector outside of the SEM enclosure which makes it easier to interface to the SEM and where it is easier to operate. However, because of the inverse square law dependence of intensity on distance from a source of x-rays, as a detector is moved farther from the source, the detected intensity drops which degrades the efficiency of a spectrometer receiving the x-rays. This can seriously affect the throughput performance, especially when a small x-ray detector is used.

Figure 1:
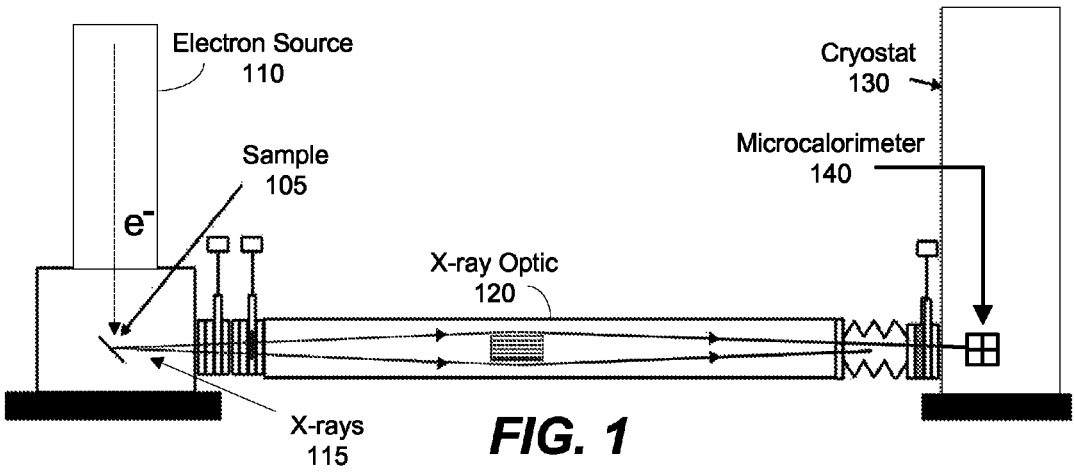
FIG. 1 is a schematic of a an exemplary scanning electron microscopy system which includes an x-ray optic and x-ray detector.

Moreover, due to the physical sizes of the instruments and their need for independent mechanical and electrical isolation, these applications often require an x-ray optic to guide the x-rays emitted from the sample in the SEM enclosure to the x-ray microcalorimeter for spectral analysis. FIG. 1 shows an exemplary SEM device, which includes a electron source 110 to generate electrons (e.g., an electron beam $e^-$) to bombard a sample 105 which, in response, generate x-rays 115. The generated x-rays 115 are guided through x-ray optic 120 to cryostat 130 where they can be detected by microcalorimeter 140. There are a number of considerations for the x-ray optic. For example, there typically is a minimum distance from the x-ray source to the location of the beam focus in the microcalorimeter to accommodate the physical size of the instruments (e.g., 0.5 meters). Additionally, the distance of the source of X-rays to the front surface of the optic often has a maximum distance to permit collection of a desired amount of X-rays by the microcalorimeter in a desired time (e.g., 0.1 meters).

These two considerations alone may impact the type of optic that may be used due to optic characteristics such as opening angle, focal length, throughput, etc. Applicant has appreciated that it is often the case that neither an optic of the GIMSO type nor an optic of the capillary type can meet the requirements of a given application satisfactorily. Applicant has recognized that a hybrid optic (e.g., an optic formed partially of the capillary optic type and partially of the GIMSO type) may be utilized to exploit the advantages of both types. For example, some embodiments of a hybrid optic may be used to satisfy the requirements of a given application, such as a SEM having particular distance requirements.

Following below are more detailed descriptions of various concepts related to, and embodiments of, methods and apparatus according to the present invention. It should be appreciated that various aspects of the invention described herein may be implemented in any of numerous ways. Examples of specific implementations are provided herein for illustrative purposes only. In addition, the various aspects of the invention described in the embodiments below may be used alone or in any combination, and are not limited to the combinations explicitly described herein.

As discussed above, Applicant has recognized the benefit of a hybrid optic formed partially from a capillary optic and partially from a GIMSO. The capillary optic may be of to any type suitable for collecting and focusing x-rays. Similarly, the GIMSO may be of any suitable type. For example, a capillary bundle and GIMSO used in a hybrid optic may be any one or combination of the types described in U.S. Pat. No. 6,594,337, entitled "X-ray Diagnostic System," which is herein incorporated by reference in its entirety. Some exemplary capillary optics and GIMSO elements suitable for use in a hybrid optic are discussed below. It should be appreciated that in a hybrid optic, only portions of each type of optic are used to form the complete hybrid optic, and the optics of a single type described below and depicted in some of the drawings are illustrated to show non-limiting examples of configurations of the capillary optic and GIMSO type optics from which those portions may be selected to form a hybrid optic.

Figure 2:
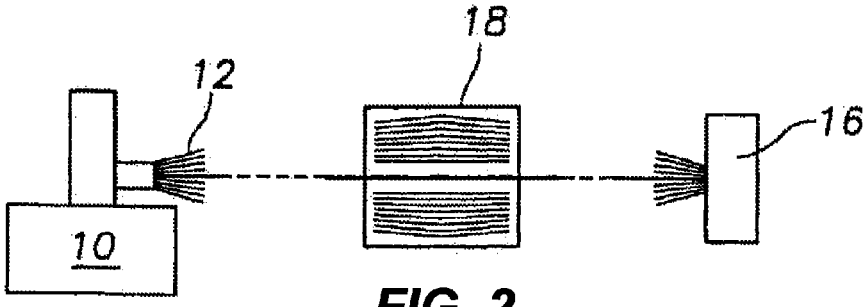
FIG. 2 illustrates a GIMSO in connection with a scanning electron microscope that generates a divergent beam of x-rays.
Figure 3:
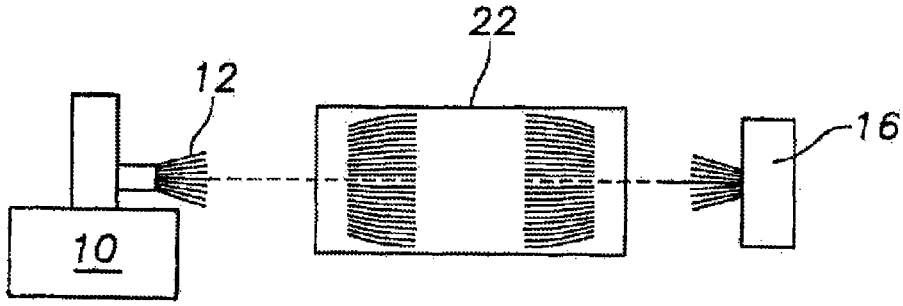
FIG. 3 illustrates a GIMSO in connection with a scanning electron microscope that generates a divergent beam of x-rays.

Some embodiments of a GIMSO type operate using single or double reflections at grazing incidence from surfaces formed from nested cylindrical, conical, cylindrical spiral or conical spiral foils. FIGS. 2 and 3 illustrate such GIMSOs in connection with a scanning electron microscope 10 that generates a divergent beam of x-rays 12. The x-rays 12 impinge upon a single reflection cylindrical or cylindrical spiral foil concentrator 18 and are focused on a spectrometer 16. In FIG. 3, the diverging beam of x-rays 12 encounters a nested conical or conical spiral foil optic concentrator 22 which similarly focuses the x-rays 12 on the spectrometer 16.

Figure 4:
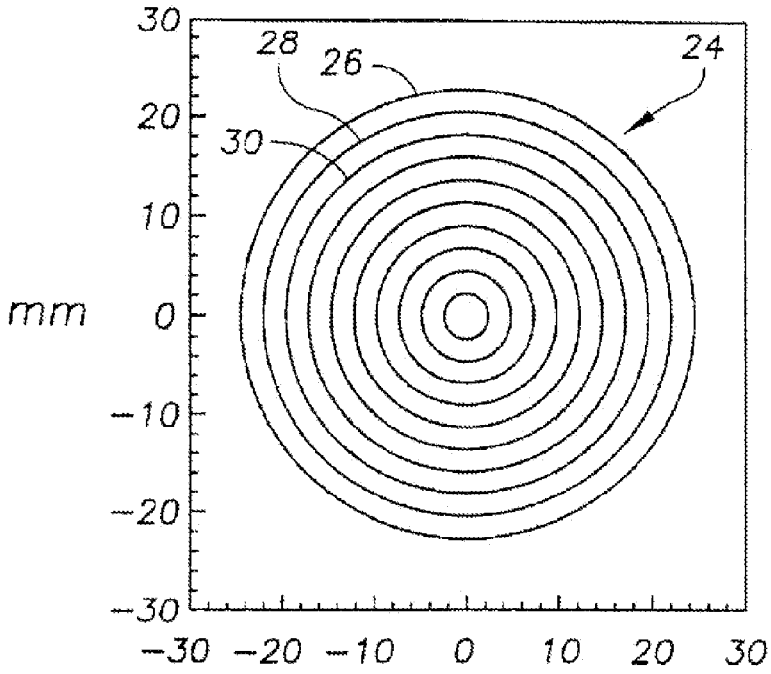
FIG. 4 illustrates an exemplary GIMSO type nested foil optic concentrator.
Figure 5:
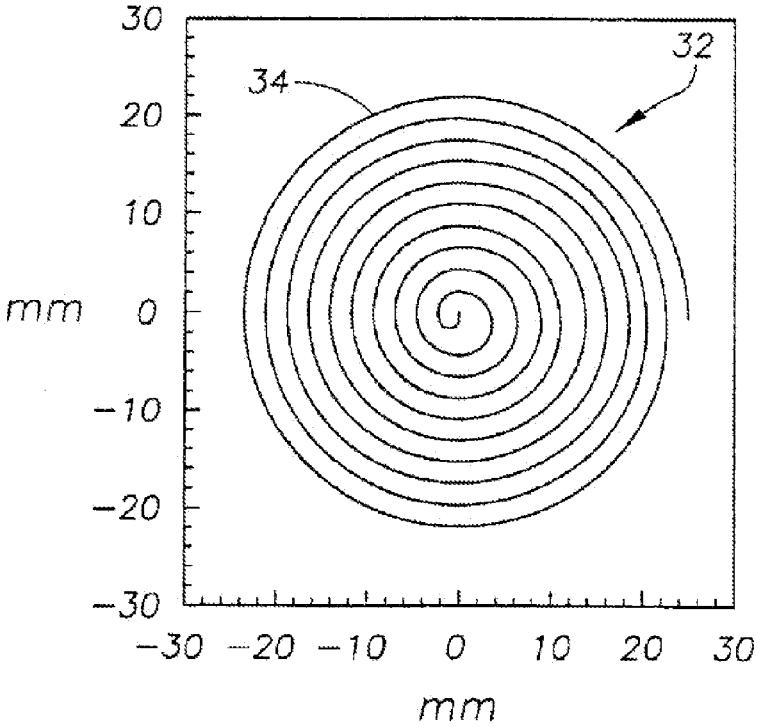
FIG. 5 illustrates an exemplary GIMSO type spiral foil optic concentrator.

Two examples of GIMSO type foil concentrators are shown in FIGS. 4 and 5. In FIG. 4, a cylindrical or conical concentrator 24 includes nested concentric cylinders or cones 26, 28, 30, etc. The concentric cylinders or cones are formed from a thin ribbon of a gold-coated plastic. The nested cylinders or cones 26, 28, 30, . . . , may also be made of glass, aluminum foil, silicon or germanium. A spiral concentrator 32 shown in FIG. 5 is formed of a relatively long single ribbon 34 that is wound into a spiral. The ribbon 34 may be gold-coated plastic, aluminum foil or quartz ribbon. Suitable plastic materials for the embodiments in FIGS. 4 and 5 include polyester, polyimide, Kapton™, melinex, hostaphan, apilcal, mylar or any suitably smooth, flexible material. One suitable plastic is available from the Eastman Kodak Company under the designation ESTAR™. Such plastic foil may range from 0.004 to 0.015 inches thick, for example. The plastic material may be coated with a thin layer of metal, preferably a high Z metal such as nickel, gold or iridium and may be coated with multilayers. A suitable thickness for the metal coating is approximately 800 Å. Evaporation or sputtering is a suitable technology for applying the metal coating to the plastic ribbon material 34. The embodiments of FIGS. 4 and 5 may be configured for single reflection as illustrated in FIG. 2 or for multiple reflections as illustrated in FIG. 3.

Some embodiments of the x-ray optics shown in FIGS. 4 and 5 use a point-to-point geometry to obtain relatively significant gain and solid angle in the energy band of 0.1 keV to 10 keV. The gain depends upon the x-ray reflectivity, focal distance, the width of the ribbon material and the number of windings of the spiral or the number of nested cylinders. The x-ray reflectivity of the concentrators 24 and 32 can be improved by depositing multilayers of W—C, Co—C, or Ni—C for example, on the uncoated or metal-coated plastic which allow the designs to include larger grazing angles, but only in a select band of energies.

Some embodiments of a GIMSO of the cylindrical spiral concentrator type (e.g., cylindrical spiral concentrator 32) are constructed using a single reflection in a point-to-point geometry in which the ribbon is wound with a pitch of ~0.05 inches and has ~19 windings within an entrance aperture with diameter of ~50 mm. For similar embodiments of a GIMSO of the cylindrical concentrator type, the ribbon may be cut into approximately 20 lengths to form concentric cylinders. The ribbon width and focal length of some embodiments may be, but are not limited to, approximately 25 mm and 1.5 m, respectively. Such x-ray optics may be suitable, for example, for an SEM in which the distance between the x-ray source of the SEM and an energy dispersive detector (e.g., a lithium-drifted silicon detector and/or x-ray microcalorimeter) is approximately two meters.

However, it should be appreciated that GIMSOs of any geometry, properties and characteristics may be chosen to satisfy requirements of a given application, as the aspects of the invention are not limited to any particular type of GIMSO nor to GIMSO having any particular set of parameter values. Moreover, a GIMSO of a single reflection type (e.g., cylindrical and spiral configurations) or double reflection types may be made of machined metal construction to form, for example, the cylinder and/or spiral geometries from rigid surfaces rather than being constructed from a material that can be bent or shaped into those geometries, such as the materials described above.

Figure 6:
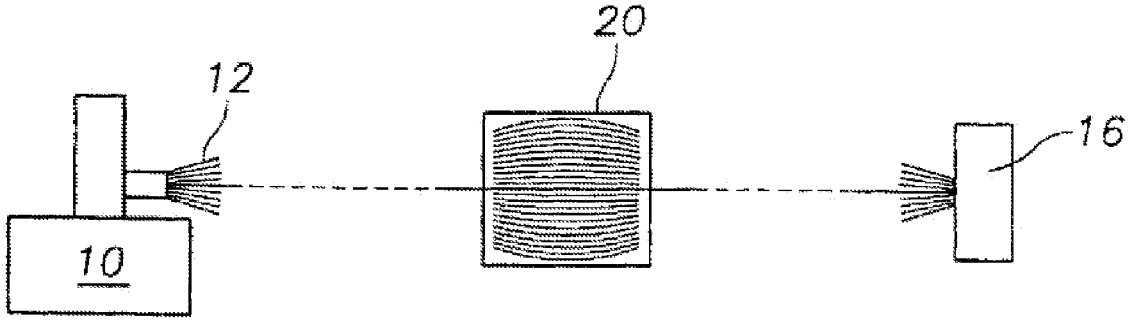
FIG. 6 illustrates a point-to-point capillary type optic.
Figure 7:
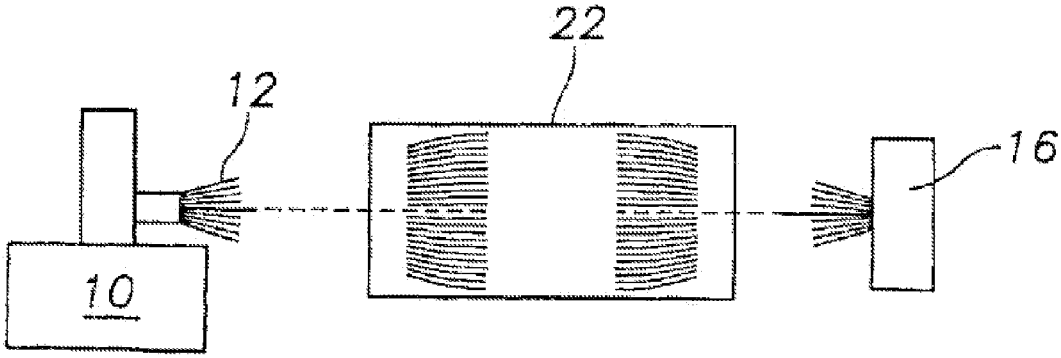
FIG. 7 illustrates a point-to-parallel capillary type optic

FIGS. 6 and 7 illustrate capillary bundle type x-ray optics. In FIG. 6, the diverging beam of x-rays 12 pass through point-to-point capillary bundle 20 which focuses the x-rays 12 onto the spectrometer 16. In FIG. 7, multiple reflection point-to parallel, parallel-to-point capillary bundles 22 similarly focus the beam 12 onto the spectrometer 16. FIG. 7 also represents a point-to-parallel followed by a parallel-to-point concentrator. Different configurations of capillary optics may be suitable to form part of a hybrid x-ray optic.

As discussed above, Applicant has recognized that portions of the capillary type x-ray optic and portions of the GIMSO type x-ray optic may be used together to form a hybrid x-ray optic. According to some embodiments, a first portion of the hybrid optic is formed from a capillary optic and a second portion of the hybrid optic is formed from a GIMSO. In some embodiments, the capillary optic portion is arranged to receive x-rays from an x-ray source and provide the x-rays to the GIMSO portion. For example, the capillary optic portion may be positioned first as the entrance for x-rays and the GIMSO portion may be positioned second as the exit for the x-rays. In some embodiments, the GIMSO portion is arranged to receive x-rays from an x-ray source and provide the x-rays to a capillary optic portion. For example, the GIMSO portion may be positioned first as the entrance for x-rays and the capillary portion may be positioned second as the exit for the x-rays.

A hybrid optic of the type wherein the capillary optic portion is positioned first and the GIMSO portion second may be utilized, for example, in a SEM device wherein the capillary optic is nearer the x-ray source and the GIMSO is nearer the detector. In some embodiments, a capillary optic is used to collect x-rays from an x-ray source within a SEM enclosure and guide the x-rays outside the enclosure and provide the x-rays to a GIMSO coupled to the capillary optic. The GIMSO may then guide and focus the x-rays on a detector located outside the SEM enclosure, such as a microcalorimeter or other such detector. By forming a hybrid optic, properties of each type of optic that may be advantageous for a given application can be utilized, at least some of these properties of which are discussed in further detail below.

Figure 8:
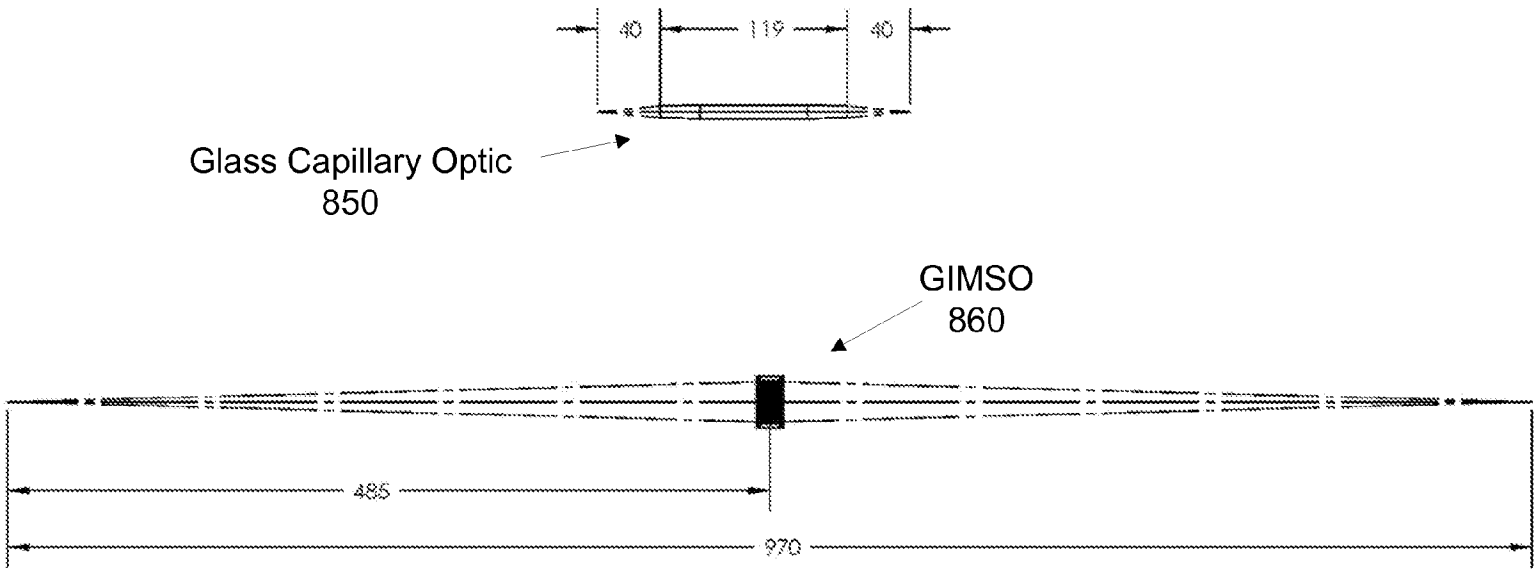
FIG. 8 schematically illustrates a point-to-point capillary type optic and a point-to-point GIMSO drawn to the same relative scale.

FIG. 8 schematically illustrates a capillary type optic 850 and a GIMSO 860 drawn to the same relative scale. The relatively short input and output focal distances of the capillary bundle may be problematic in some applications such as an SEM device in which the detector is located outside of the enclosure for the electron and x-ray source. GIMSO type optics, however, can provide relatively large input and output focal distances. As discussed in further detail below, the size of the opening angles for both types of optics are interdependent on the energy bandpass and input focal distances.

Figure 9:
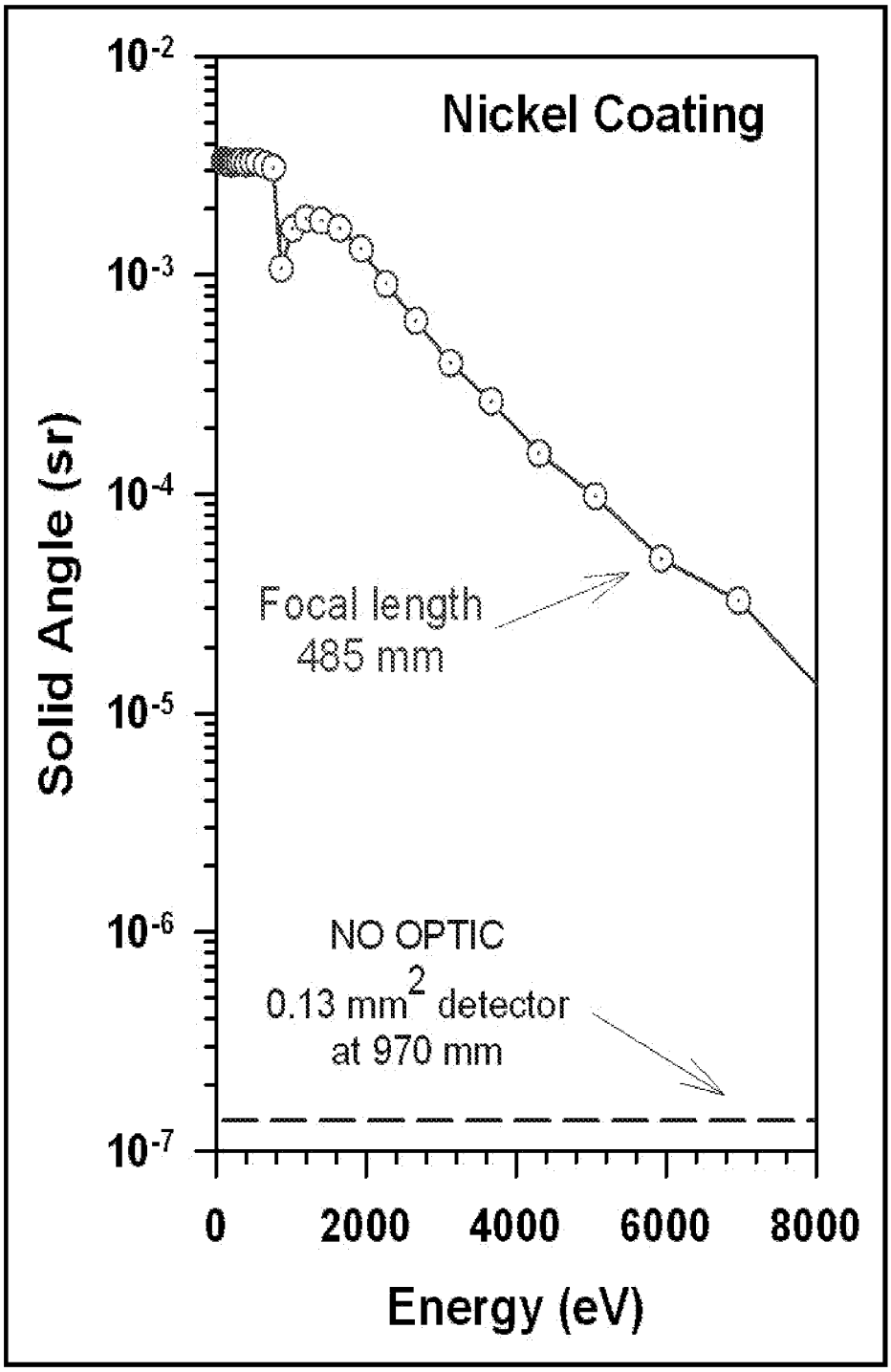
FIG. 9 illustrates solid angle of collection variation with energy for a GIMSO coated with nickel, an aperture diameter of 25 mm and input and output focal distances of 485 mm.

The energy bandpass of the GIMSO in the point-to-point, cylindrical, geometry depends on the range of incident angles at the entrance aperture of the optic. These angles are to determined by the input focal distance and the diameter of the aperture. For a fixed aperture size, FIG. 9 shows how the solid angle of collection for such an optic coated with nickel, an aperture diameter of 25 mm and input and output focal distances of 485 mm varies with energy. The dotted line represents the solid angle subtended by a detector with the size of the optic's focal spot placed at 970 mm, the distance at which the optic will focus its x-rays. As shown, the optic serves to increase the collection solid angle by ~$10^4$ times at 2 keV and ~$10^2$ times at 8 keV.

Figure 10:
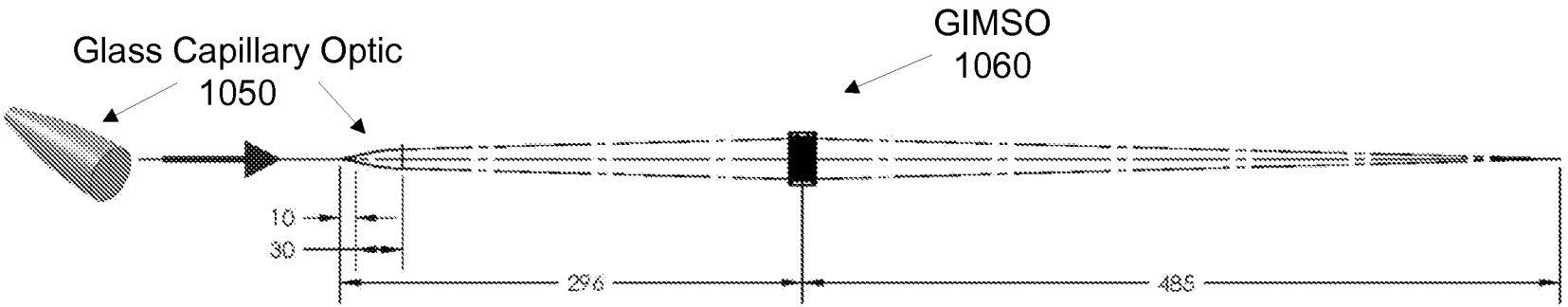
FIG. 10 illustrates a hybrid optic formed from a capillary optic portion and a GIMSO portion.

For many applications, the solid angle, focal length and associated bandpass combinations of GIMSO type optics provide adequate x-ray intensity for a detector that has dimensions that match the image size of the optic. However, for SEM applications where the density of atoms in the target material is relatively low compared to solids, one or more properties of a GIMSO optic may be insufficient. For example, in biomedical imaging of cellular structures, the x-ray intensity will be significantly diminished because the number of interactions between the electrons and the atoms in the cellular tissue is relatively low. Reduced x-ray collection makes it difficult to generate a spectroscopic x-ray image in a short time. If it is desirable to locate the x-ray detector outside of the SEM enclosure, it may be difficult to increase the solid angle of collection with a GIMSO without significantly reducing the energy bandpass. A hybrid optic according to some embodiments may address at least some of the difficulties presented by such systems. For example, FIG. 10 illustrates a hybrid optic formed from a capillary optic portion 1050 and a GIMSO portion 1060 to utilize advantageous properties of each type of optic (e.g., the capillary optic for its relatively large collection angle and the GIMSO for its relatively high reflection efficiency and relatively long focal length).

Capillary optics can be fabricated with opening angles as large as 20 degrees. This is about 6 to 10 times the opening angle for a typical single reflection, cylindrical GIMSO. Since the solid angle of collection is proportional to the square of the opening angle, the capillary optic 1050 may collect 36 to 100 times more x-rays than if a typical GIMSO was used to collect x-rays from the source. However, this increase requires that the capillary optic have a relatively short input focal distance (e.g., a focal distance of 10-20 mm) A hybrid optic can use this wide angle, short focal length, capillary portion to collect x-rays using a point-to-parallel or point-to-diverging geometry. The outgoing x-rays (e.g., parallel or diverging x-rays) may then be provided to the GIMSO. The GIMSO can take several forms to when used in the hybrid configuration, depending on whether the x-rays leaving the capillary bundle are parallel or diverging. If the emerging x-rays are parallel, the GIMSO may have a parallel-to-point geometry such as a single reflection, paraboloid or its conical approximation, a double reflection Wolter I or Kirkpatrick-Baez geometry or their equivalent conical approximations.

Figure 11:
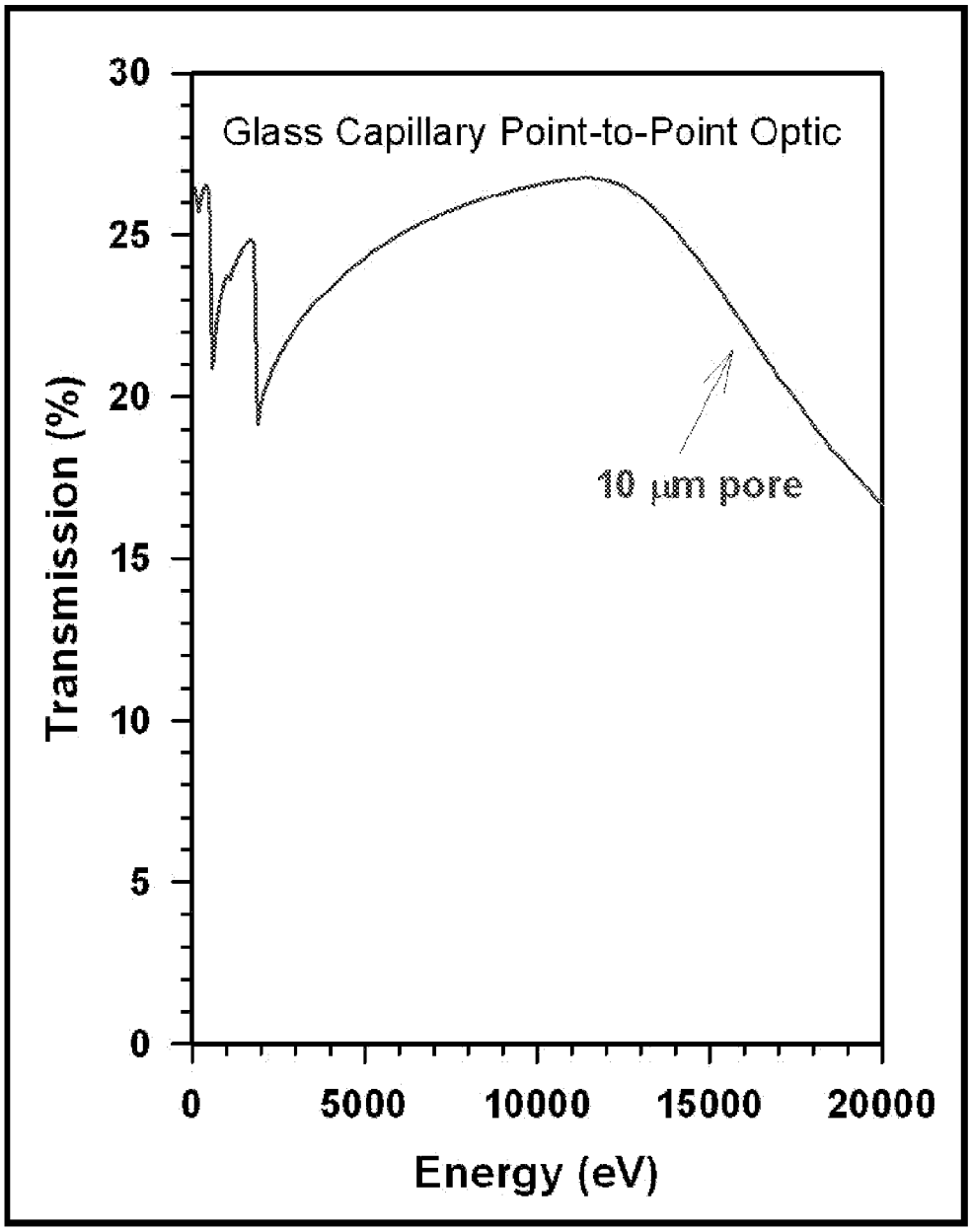
FIG. 11 illustrates energy bandpass for transmission of point-to-point capillary optics with 10 μm diameter pores.

If the emerging x-rays are diverging, the GIMSO may have a single reflection cylindrical geometry or a spiral approximation. It could also have a double reflection, elliptical geometry or its conical approximation. The relatively short input focal distance of the capillary optic does not have the same effect on the energy bandpass as that of the relatively long focal length GIMSO because the x-rays undergo many reflections in the glass capillaries at angles that are significantly smaller than the critical angles for x-ray energies as high as 10 keV. This is shown in FIG. 11, which illustrates that for transmission of point-to-point capillary optics with 10 μm diameter pores, the energy bandpass is quite large for the optic compared with the GIMSO.

In some embodiments of a hybrid optic, the output end of the capillary optic is fabricated so that capillaries, which naturally diverge from the center line, allow the x-rays that exit at the extreme edge of the capillary optic to make an angle with respect to the centerline that coincides with the maximum acceptance angle of a single reflection GIMSO. For example, a glass capillary bundle with a 20 degree opening angle and short input focal distance may be used to collect the x-rays and output x-rays at angles that match the input angle of the relatively long focal length GIMSO (e.g., an acceptance half angle of ~1.5 degrees for a typical cylindrical spiral GIMSO with a focal length of 485 mm) FIG. 10 illustrates an embodiment where diverging x-rays from the capillary portion of the hybrid optic are matched to the acceptance angle of the GIMSO portion. According to other embodiments of a hybrid optic, the x-rays that leave the capillary portion are parallel to the centerline. For this configuration, the GIMSO may have a single or double reflection, parallel-to-point geometry.

Figure 12:
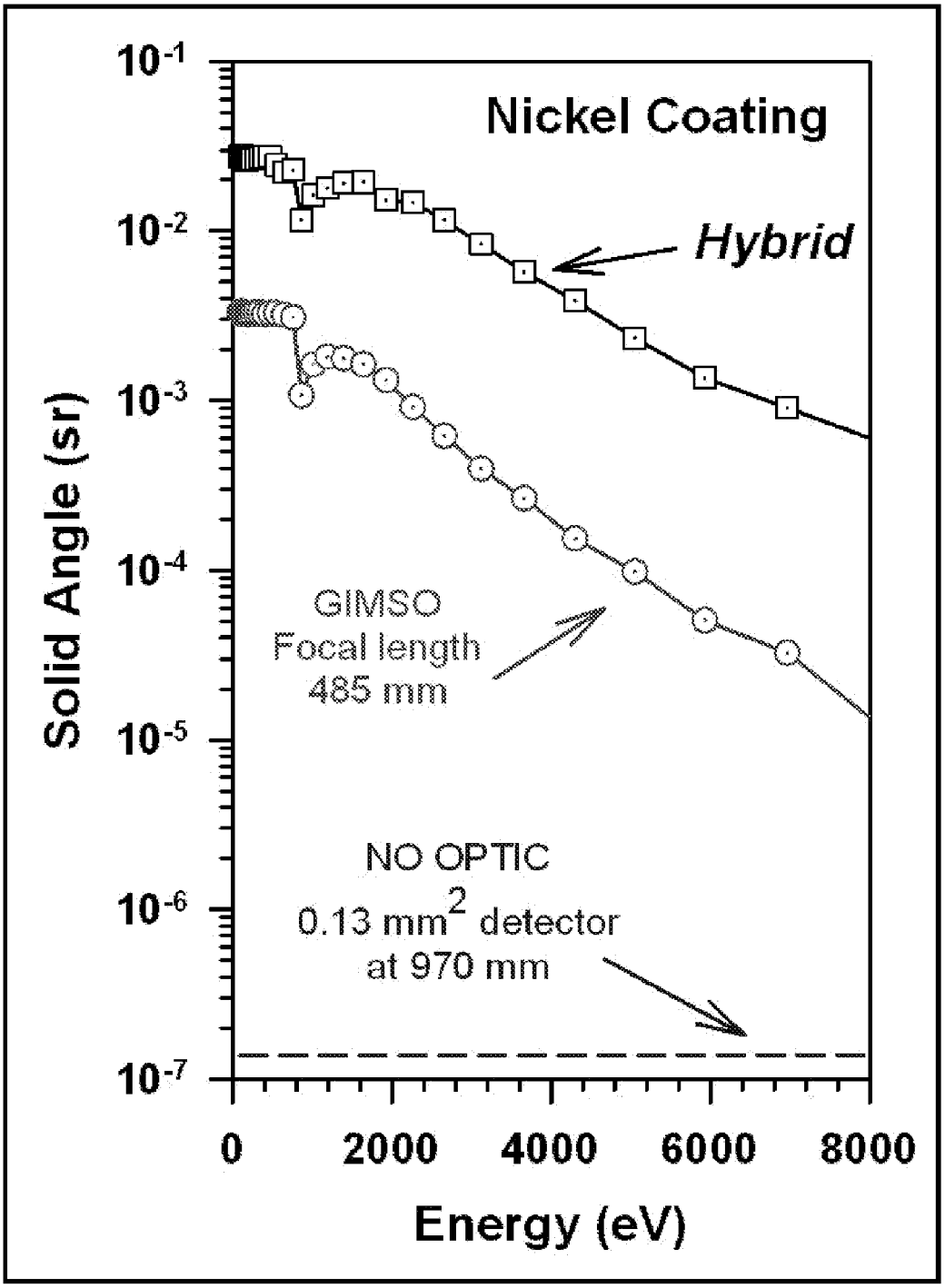
FIG. 12 illustrates improvement in the solid angle of collection that may be achieved using some embodiments of a hybrid optic.

FIG. 12 illustrates improvement in the solid angle of collection that may be achieved using some embodiments of a hybrid optic. In FIG. 12, results using a GIMSO coated with nickel in the point-to-point, single reflection configuration are compared with results that can be expected from a hybrid optic having a capillary optic portion incorporating a 20 degree opening angle with an output half angle of 1.5 degrees to match the input aperture half angle to of a GIMSO portion having a 485 mm focal length. Since the capillary portion transmits a larger bandpass than the GIMSO, the ultimate bandpass of the hybrid configuration is determined by the focal length of the GIMSO. The GIMSO can have alternate coatings such as gold, iridium, platinum or a multi-layer. The shells may be plastic, aluminum, glass or any other smooth surface.

The increase in the solid angle of reflection ranges from a factor of 10 times at 2 keV to almost 100 times at 8 keV for the configuration shown in FIG. 7. By increasing the input focal distance to lower the acceptance angle of the GIMSO, the energy bandpass can be increased. In some embodiments, the geometry of the hybrid optic is designed for detectors with small active areas such as those in a cryogenic microcalorimeter. Since the intrinsic short input focal distance and the somewhat longer but still restrictive output focal distance of a capillary optic in the point-to-point geometry limits the placement of the detector to within 200 mm of the SEM focal spot, such embodiments of a hybrid optic makes it considerably easier to locate a microcalorimeter, or any x-ray detector with a small active area, outside of the SEM enclosure (>500 mm) while providing satisfactory solid angle of collection.

It should be appreciated that hybrid optics can be formed from any suitable combination of capillary and GIMSO portions to create a hybrid optic suitable for a particular application. Some exemplary embodiments are described in further detail below.

Figure 13A:
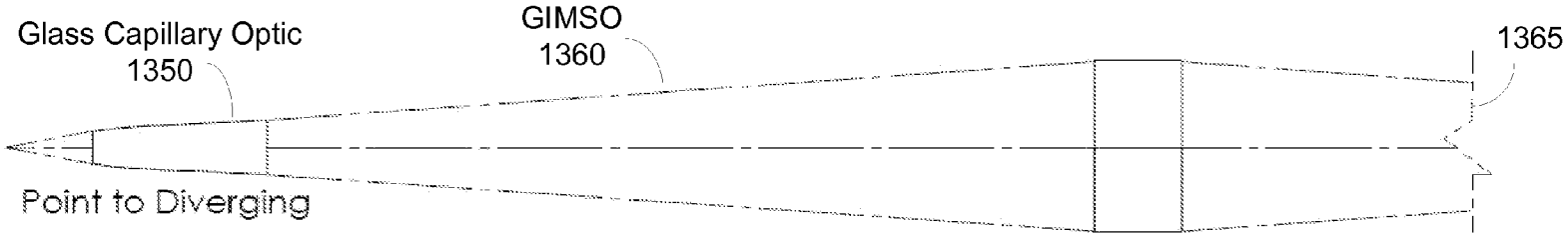
FIG. 13A illustrates an embodiment of a hybrid optic formed by a point-to-diverging capillary optic coupled to a cylindrical spiral GIMSO.
Figure 13B:
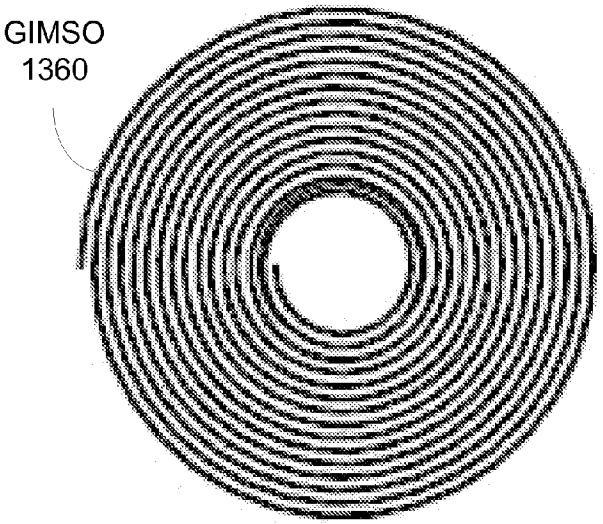
FIG. 13B illustrates a cross-section of the GIMSO along the cross-sectional cut 1365 shown on the right side of the GIMSO portion in FIG. 13A.

FIG. 13A illustrates an embodiment of a hybrid optic formed by a point-to-diverging capillary optic coupled to a cylindrical spiral GIMSO. FIG. 13B illustrates a cross-section of the GIMSO along the cross-sectional cut 1365 shown on the right side of the GIMSO portion in FIG. 13A. The capillary optic may have an input acceptance angle that is greater than 3 degrees and more preferably greater than 6 degrees. The capillaries may monotonically diverge from the optic axis at the output of the capillary portion. The maximum divergence angle may be chosen to match the input acceptance angle of the GIMSO. The x-rays emerging from the capillary optic undergo a single reflection in the GIMSO. This hybrid optic has a relatively short input focal length (e.g., ≤60 mm) characteristic of the capillary optic and the relatively long output focal distance (e.g., >100 mm) characteristic of the GIMSO.

Figure 14A:
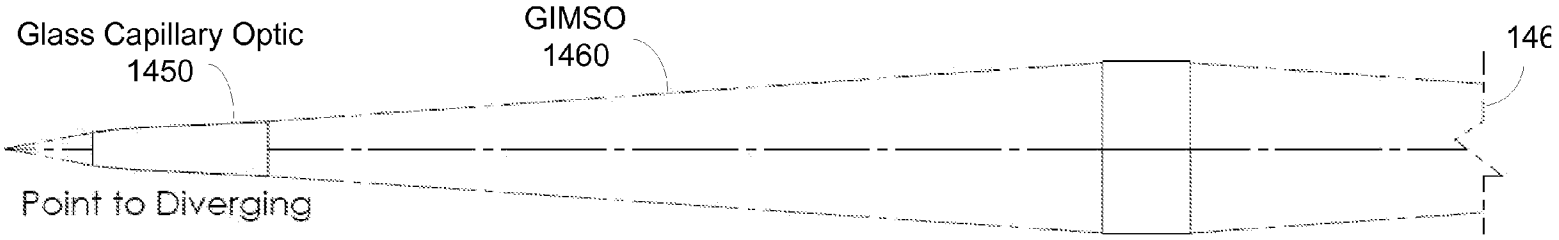
FIG. 14A illustrates an embodiment of a hybrid optic formed by a point-to-diverging capillary optic coupled to a nested cylindrical shell GIMSO.
Figure 14B:
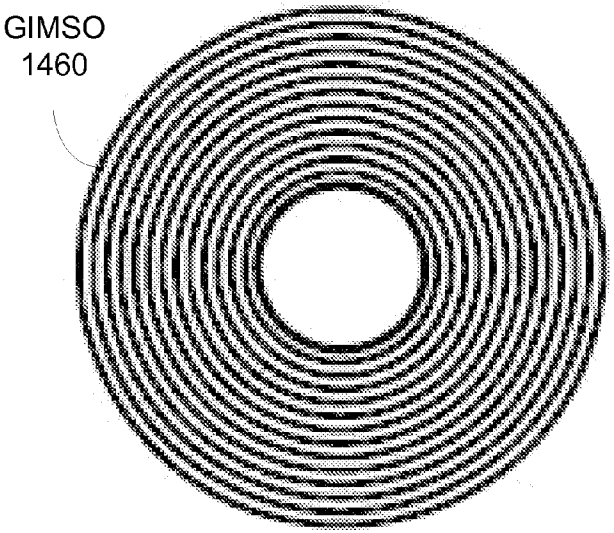
FIG. 14B illustrates a cross-section of the GIMSO along the cross-sectional cut 1465 shown on the right side of the GIMSO portion in FIG. 14A.

FIG. 14A illustrates an embodiment of a hybrid optic formed by a point-to-diverging capillary optic coupled to a nested cylindrical shell GIMSO. FIG. 14B illustrates a cross-section of the GIMSO along the cross-sectional cut 1465 shown on the right side of the to GIMSO portion in FIG. 14A. The capillary optic may have an input acceptance angle that is greater than 3 degrees and more preferably greater than 6 degrees. The capillaries may monotonically diverge from the optic axis at the output of the capillary portion. The maximum divergence angle may be chosen to match the input acceptance angle of the GIMSO. The x-rays emerging from the capillary optic undergo a single reflection in the GIMSO. This hybrid optic has a relatively short input focal length (e.g., ≤60 mm) characteristic of the capillary optic and the relatively long output focal distance (e.g., >100 mm) characteristic of the GIMSO.

Figure 15A:
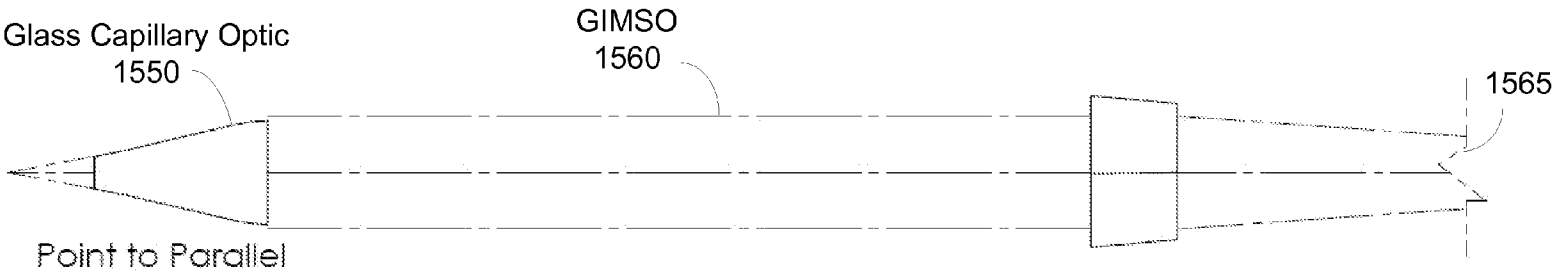
FIG. 15A illustrates an embodiment of a hybrid optic formed by a point-to-parallel capillary optic coupled to a conical spiral GIMSO.
Figure 15B:
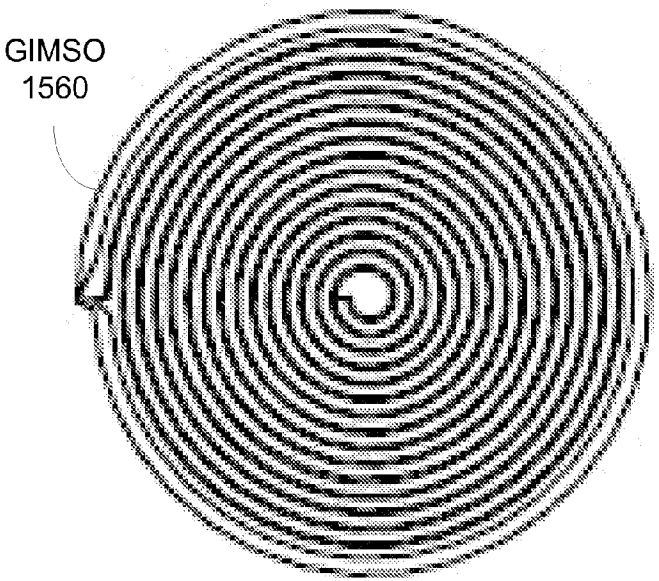
FIG. 15B illustrates a cross-section of the GIMSO along the cross-sectional cut 1565 shown on the right side of the GIMSO portion in FIG. 15A.

FIG. 15A illustrates an embodiment of a hybrid optic formed by a point-to-parallel capillary optic coupled to a conical spiral GIMSO. FIG. 15B illustrates a cross-section of the GIMSO along the cross-sectional cut 1565 shown on the right side of the GIMSO portion in FIG. 15A. The capillary optic may have an input acceptance angle that is greater than 3 degrees and more preferably greater than 6 degrees. The capillaries may provide x-rays parallel to the axis of the capillary portion. Hence, the x-rays may be emitted from the capillary portion as a parallel beam of x-rays that enter the GIMSO and undergo a single reflection in the GIMSO. This hybrid optic has a relatively short input focal length (e.g., ≤60 mm) characteristic of the capillary optic and the relatively long output focal distance (e.g., >100 mm) characteristic of the GIMSO.

Figure 16A:
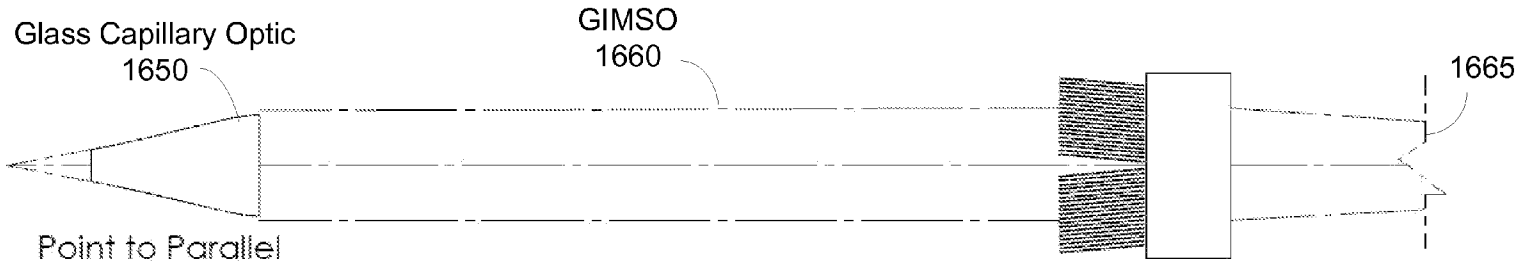
FIG. 16A illustrates an embodiment of a hybrid optic formed by a point-to-parallel capillary optic coupled to a Kirkpatrick-Baez GIMSO.
Figure 16B:
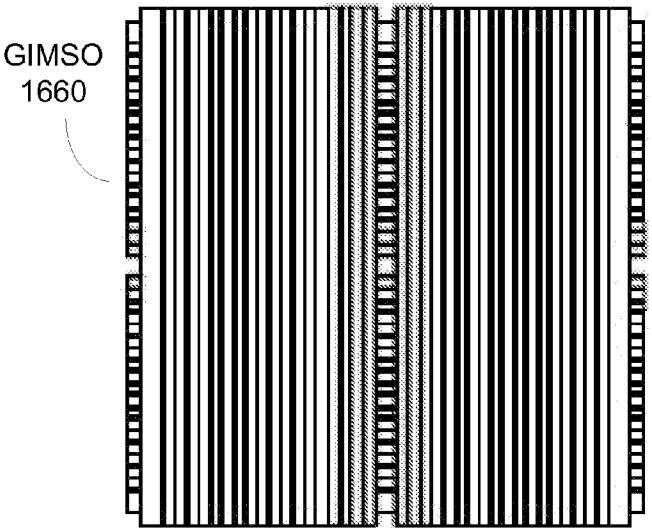
FIG. 16B illustrates a cross-section of the GIMSO along the cross-sectional cut 1665 shown on the right side of the GIMSO portion in FIG. 16A.

FIG. 16A illustrates an embodiment of a hybrid optic formed by a point-to-parallel capillary optic coupled to a Kirkpatrick-Baez GIMSO. FIG. 16B illustrates a cross-section of the GIMSO along the cross-sectional cut 1665 shown on the right side of the GIMSO portion in FIG. 16A. The capillaries may provide x-rays parallel to the axis of the capillary portion. Hence, the x-rays may be emitted from the capillary portion as a parallel beam of x-rays that enter the GIMSO and undergo two reflections in the GIMSO, the first reflection off of a parabolic surface (or a flat plate approximation) and the second reflection off of another parabolic surface (or a flat plate approximation) rotated by 90 degrees around the optic axis from the first surface. This hybrid optic has a relatively short input focal length (e.g., ≤60 mm) characteristic of the capillary optic and the relatively long output focal distance (e.g., >100 mm) characteristic of the GIMSO.

Figure 17A:
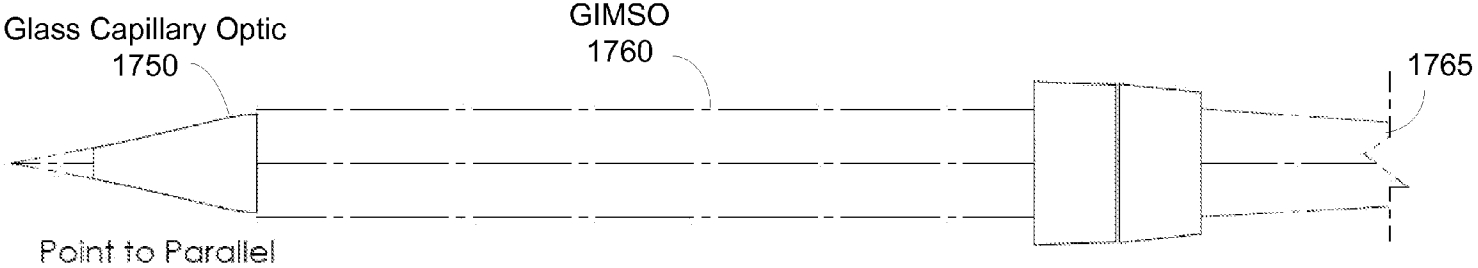
FIG. 17A illustrates an embodiment of a hybrid optic formed by a point-to-parallel capillary optic coupled to a Wolter type GIMSO.
Figure 17B:
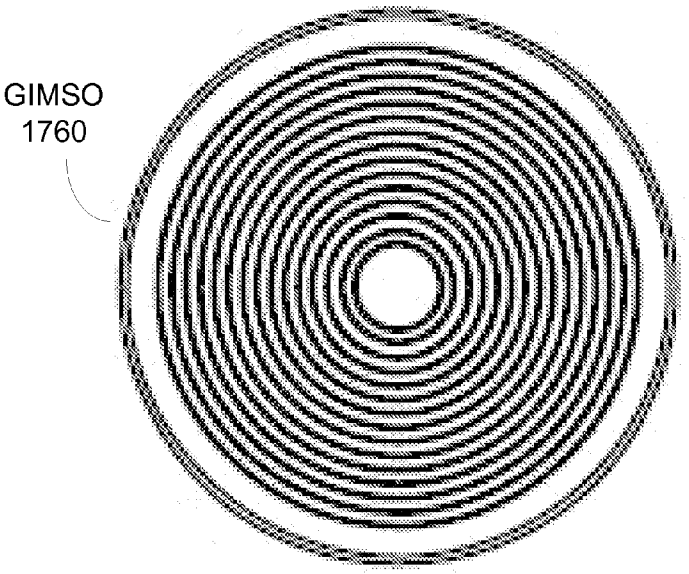
FIG. 17B illustrates a cross-section of the GIMSO along the cross-sectional cut 1765 shown on the right side of the GIMSO portion in FIG. 17A.

FIG. 17A illustrates an embodiment of a hybrid optic formed by a point-to-parallel capillary optic coupled to a Wolter type GIMSO. FIG. 17B illustrates a cross-section of the GIMSO along the cross-sectional cut 1765 shown on the right side of the GIMSO portion in to FIG. 17A. The capillaries may provide x-rays parallel to the axis of the capillary portion. Hence, the x-rays may be emitted from the capillary portion as a parallel beam of x-rays that enter the GIMSO and undergo two reflections in the GIMSO, the first reflection off of a parabolic surface (or a conical approximation) and the second reflection off of a hyperbolic surface (or conical approximation). This hybrid optic has a relatively short input focal length (e.g., ≤60 mm) characteristic of the capillary optic and the relatively long output focal distance (e.g., >100 mm) characteristic of the GIMSO.

It should be appreciated that any of the variety of capillary optics may be combined with any of the variety of GIMSO types, as the aspects of the invention are not limited to any particular combination or any specific combination illustrated herein. In addition, while some embodiments of hybrid x-ray optics are described in connection with SEM devices, it should be appreciated that hybrid x-ray optics described herein may be suitable for use in any other device that uses x-ray optics to collect, guide and/or focus x-rays, particularly devices that could benefit from exploiting one or more advantageous properties of the two types of x-ray optics.

The above-described embodiments of the present invention can be implemented in any of numerous ways, and the examples described herein are not limiting. In addition, various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

What is claimed is:

1. A hybrid optic comprising:

a capillary optic for receiving x-rays from an x-ray source at an entrance portion of the capillary optic and configured to provide substantially parallel or substantially diverging x-rays at an exit portion of the capillary optic; and a grazing incidence multi-shell optic (GIMSO) coupled, at an entrance portion of the GIMSO, to the exit portion of the capillary optic to receive the substantially parallel or substantially diverging x-rays emerging from the exit portion of the capillary optic, the GIMSO comprising an exit portion for providing x-rays.

2. The hybrid optic of claim 1, wherein the capillary optic is configured to receive substantially diverging x-rays at the entrance portion and configured to provide substantially diverging x-rays at the exit portion of the capillary optic.

3. The hybrid optic of claim 2, wherein the GIMSO is directly coupled to the capillary optic and configured to receive the substantially diverging x-rays directly from the exit portion of the capillary optic and configured to provide substantially converging x-rays at the exit portion of the GIMSO.

4. The hybrid optic of claim 1, wherein the capillary optic is configured to receive substantially diverging x-rays at the entrance portion and configured to provide substantially parallel x-rays at the exit portion of the capillary optic.

5. The hybrid optic of claim 4, wherein the GIMSO is directly coupled to the capillary optic and configured to receive the substantially parallel x-rays directly from the exit portion of the capillary optic and to provide substantially converging x-rays at the exit portion of the GIMSO.

6. The hybrid optic of claim 1, wherein the acceptance angle of x-rays at the entrance portion of the capillary optic is greater than 3 degrees from a central axis of the capillary optic.

7. The hybrid optic of claim 1, wherein the acceptance angle of x-rays at the entrance portion of the capillary optic is greater than 6 degrees from a central axis of the capillary optic.

8. The hybrid optic of claim 1, wherein the capillary optic has a focal length less than or equal to 60 mm and the GIMSO has a focal distance greater than 100 mm.

9. The hybrid optic of claim 1, wherein the GIMSO comprises a single reflection optic.

10. The hybrid optic of claim 1, wherein the GIMSO comprises a double reflection optic.

11. The hybrid optic of claim 1, wherein the GIMSO comprises a cylindrical spiral geometry.

12. The hybrid optic of claim 1, wherein the GIMSO comprises a conical spiral geometry.

13. The hybrid optic of claim 1, wherein the GIMSO comprises a nested cylinder geometry.

14. The hybrid optic of claim 1, wherein the GIMSO comprises a metal coated foil capable of being shaped into a desired geometry.

15. The hybrid optic of claim 1, wherein the GIMSO comprises a machined metal surface rigidly manufactured into a desired geometry.

16. The hybrid optic of claim 14, wherein the metal comprises at least one of nickel, gold and iridium and the foil comprises at least one of a plastic foil, aluminum foil and quartz ribbon.

17. The hybrid optic of claim 10, wherein the GIMSO includes a first surface positioned to reflect x-rays provided by the capillary optic and a second surface to reflect x-rays reflected from the first surface.

18. The hybrid optic of claim 17, wherein the first surface includes a first parabolic surface and the second surface includes a second parabolic surface.

19. The hybrid optic of claim 17, wherein the first surface includes a parabolic surface and the second surface includes a hyperbolic surface.

20. The hybrid optic of claim 1, wherein the capillary optic comprises a bundle of glass capillary tubes.

* * * * *